US005806205A

United States Patent [19]

Varvat

[11] Patent Number: 5,806,205

[45] Date of Patent: Sep. 15, 1998

[54] METHOD AND APPARATUS FOR DEHYDRATING PARTICULATE MATERIAL

[76] Inventor: Philippe Varvat, 1264 Alexis Lebert Street, Saint-Luc, Quebec, Canada, J2W 1Y9

[21] Appl. No.: 632,454

[22] PCT Filed: Oct. 18, 1994

[86] PCT No.: PCT/CA94/00580

§ 371 Date: Apr. 18, 1996

§ 102(e) Date: Apr. 18, 1996

[87] PCT Pub. No.: WO95/11416

PCT Pub. Date: Apr. 27, 1995

[30] Foreign Application Priority Data

Oct. 18, 1993 [CA] Canada ..... 2108597

[51] Int. Cl.[6] ..... F26B 11/12

[52] U.S. Cl. ..... 34/181; 34/179; 34/185; 34/203

[58] Field of Search ..... 34/203, 208, 207, 34/179, 180, 181, 185, 182, 183

[56] References Cited

U.S. PATENT DOCUMENTS 2,259,210 10/1941 Modave .
4,361,100 11/1982 Hinger .
4,872,949 10/1989 Wilwerding .
5,220,733 6/1993 Bothe et al. .
5,293,696 3/1994 Schmidt et al. .

FOREIGN PATENT DOCUMENTS 0 038 420 10/1981 European Pat. Off. .
553783 8/1993 European Pat. Off. .
WO90/09967 9/1990 WIPO .

*Primary Examiner*—Henry A. Bennett
*Assistant Examiner*—Pamela A. Wilson
*Attorney, Agent, or Firm*—Quarles & Brady

[57] ABSTRACT

The apparatus includes a channel having an inlet end for receiving particulate material to be dehydrated and an outlet end for discharging the particulate material in a dehydrated condition. A screw conveyor rotatably mounted in the channel advances the particulate material while stirring the particulate material to enhance the release of water and noxious vapors. A fan creates an air current in the channel to entrain water and noxious vapors released by the particulate material. The vapors are directed toward a heating chamber which incinerates dangerous and odoriferous compounds as much as possible. The resulting gaseous media is directed through a passage in a heat-exchange relationship with the channel to elevate the temperature of the particulate material that is being processed and to cause same to release water and noxious vapors. The passage is isolated from the channel to avoid direct contract between the burned gases that are released in the atmosphere with yet unburned gases aspirated from the channel.

9 Claims, 4 Drawing Sheets

METHOD AND APPARATUS FOR DEHYDRATING PARTICULATE MATERIAL

This application claims the benefits of PCT/CA94/00580 filed Oct. 18, 1994.

FIELD OF THE INVENTION

The present invention relates to a method and apparatus for dehydrating particulate material. Advantageously, the invention finds applications in the processing of waste matter such as toxic slurries, organic residue produced by meat processing plants, among others, in order remove water from the waste matter and also to remove odours and sterilize the waste matter.

For the purpose of this specification, the expression "particulate material" acquires a generic meaning and it is intended to encompass a collection of particles formed into a mass that contains water such as a watery mixture of substantially insoluble material (i.e, mud, slurry etc.) or an aggregate of discrete particles containing water. The term "dehydrate" is intended to designate a significant reduction in the water content of a certain material, without necessarily implying that the material is totally free of water.

SUMMARY OF THE INVENTION

As embodied and broadly described herein, the invention provides an apparatus for dehydrating particulate material, said apparatus comprising:

a channel having an inlet end for receiving particulate material to be dehydrated and an outlet end for discharging the particulate material in a dehydrated condition, said channel constituting a passageway to convey an air current therein in order to collect and transport water vapour released by the particulate material;

a screw conveyor rotatably mounted in said channel, said screw conveyor constituting means for:

a) moving the particulate material along said channel in a direction from said inlet end toward said outlet end; and b) stirring the particulate material to cause disturbance in the relative position of particles thereof, whereby enhancing release of water vapour;

a duct in a heat-exchange relationship with said channel, said duct conveying heated gas that communicates thermal energy to the particulate material in said channel to cause the particulate material to release water vapour, said duct being substantially isolated from said channel at least over a substantial segment of said channel in order to prevent contact between gaseous media in said passageway and in said duct over said substantial segment;

a heating chamber establishing a flow path between said duct and said channel and elevating a temperature of a gaseous medium flowing therethrough, whereby a mixture of air and water vapour egressing said passageway is supplied to said heating chamber to achieve heat gain and is then supplied to said duct in order to transfer heat to particulate material in said channel.

In a most preferred embodiment, the particulate material processed b, the apparatus is conveyed along a serpentine path comprising a plurality of horizontally disposed segments that are vertically offset one relative to the other. Each segment contains at least one screw conveyor that transports the particulate material from one end of the segment to the other. When the particulate material reaches the end of a given segment, it falls by gravity into the following segment of the path that is located at the lower level. An arrangement of baffles between the various segments of the serpentine path establishes two passageways for channelling gaseous media. The first passageway follows the serpentine path and is exposed to the particulate material being dehydrated in order to collect water and noxious vapours that are being released. More particularly, a fan creates an air current that flows in a direction contrary to the direction of movement of the particulate material in order to collect and transport water and noxious vapours released by the particulate material. At the end of the first passageway, the gases released by the particulate matter pass through a heating chamber that elevates the temperature of the gases to at least 750° C. in order to incinerate the noxious vapours as much as possible. The hot and relatively clean gas is then directed to the second passageway which also follows the serpentine path in order to elevate the temperature of the particulate material and cause water and noxious vapours to be released. The arrangement of the first and second passageways is such as to prevent the hot gas media discharged from the heating chamber and the gas released by the particulate material that is being drawn toward the heated chamber to mix with each other. The purpose of this arrangement is to prevent incinerated gases that are relatively clean to become contaminated with noxious vapours.

As embodied and broadly described herein, the invention also provides a method for dehydrating particulate material, said method comprising the steps of:

loading particulate material to be dehydrated into a channel that constitutes a passageway to convey an air current therein in order to collect and transport water vapour released by the particulate material;

advancing the particulate material along said channel while stirring the particulate material in order to enhance vapour release by the particulate material;

heating a gas egressing said passageway that contains a mixture of air and water vapour released by the particulate material;

passing the heated gas in contact with said channel to transfer thermal energy to the particulate material therein without mixing the heated gas with gaseous media in said passageway.

As embodied and broadly described herein, the invention also provides an apparatus for dehydrating toxic particulate material, said apparatus comprising:

a channel having an inlet end for receiving toxic particulate material to be dehydrated and an outlet end for discharging the toxic particulate material in a dehydrated condition, said channel constituting a passageway to convey an air current therein in order to collect and transport water and noxious vapours released by the particulate material;

a screw conveyor rotatably mounted in said channel, said screw conveyor constituting means for:

a) moving the toxic particulate material along said channel in a direction from said inlet end toward said outlet end; and b) stirring the toxic particulate material to cause disturbance in the relative position of particles thereof, whereby enhancing release of water and noxious vapours;

a heating chamber in fluid communication with an outlet orifice of said passageway, said heating chamber heating gases conveyed by said passageway for incinerating noxious vapours released by the toxic particulate material;

a duct in fluid communication with said heating chamber for discharging gaseous media therefrom, said duct being in a heat-exchange relationship with said channel for communicating thermal energy to the particulate material in said channel to cause the particulate material to release water vapour, said duct being substantially isolated from said channel in order to prevent contamination of the gaseous media discharged from said heating chamber with noxious vapours released by the particulate material.

DESCRIPTION OF A PREFERRED EMBODIMENT

The present invention provides an apparatus for dehydrating particulate material that has the ability of incinerating noxious vapours released during the treatment and it is therefore suitable for processing watery toxic refuse.

Figure 1:
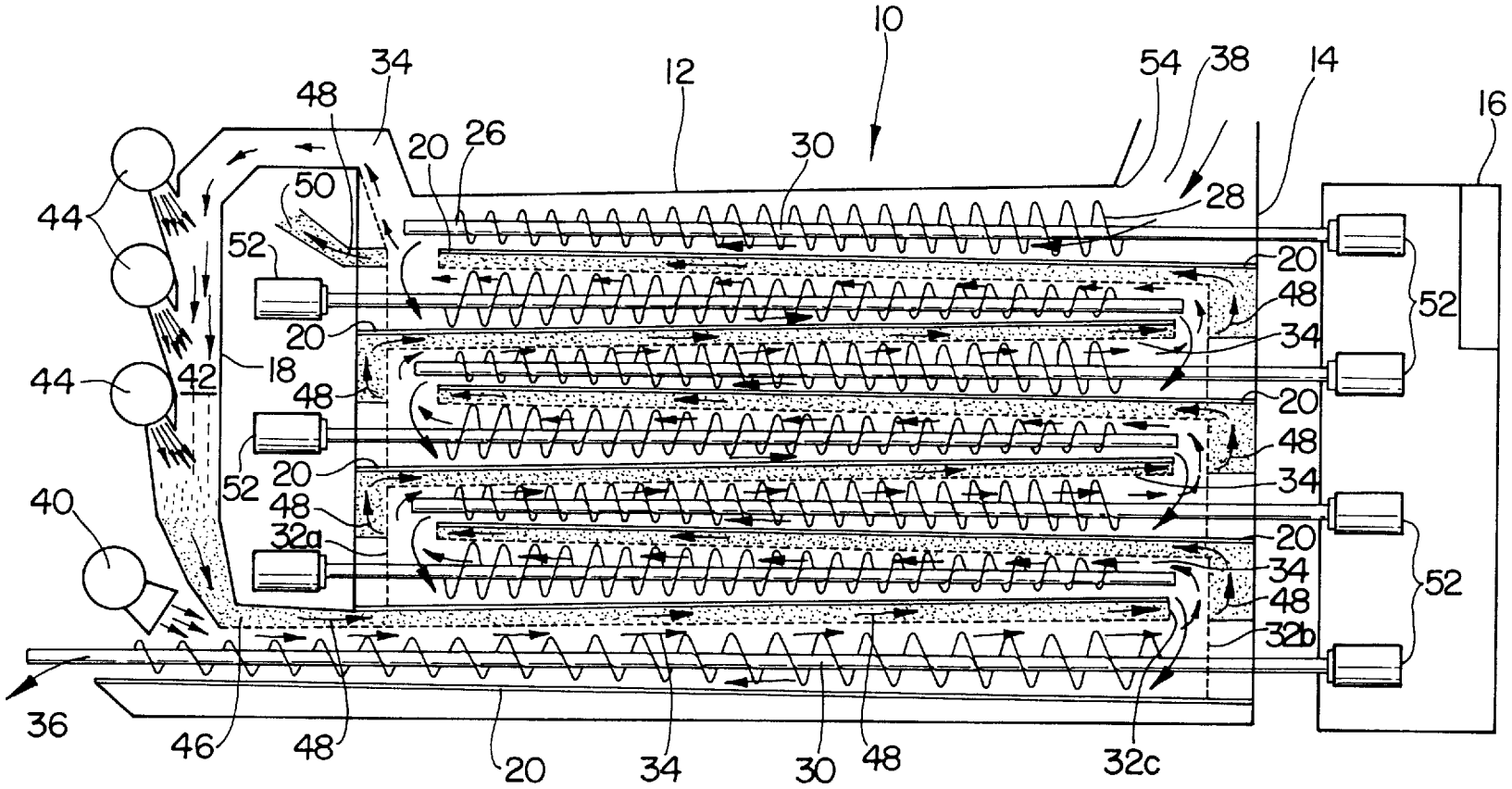
FIG. 1 is a schematical vertical cross-sectional view of the apparatus in accordance with the invention.

With reference to FIG. 1 of the annexed drawings, the apparatus, designated comprehensively by the reference numeral 10, comprises a casing 12 made of suitable material. Stainless steel is preferred for its corrosion resistance properties. The casing 12 is divided in three enclosures that perform separate functions of the apparatus. The central and largest enclosure 14 is the main processing zone through which the particulate material advances along a serpentine path and it is subjected to heat in order to release the water and noxious vapours contained therein. On the right side of the processing zone 14 is formed a controls enclosure 16 in which are housed the various drives and electronic controls of the apparatus 10. On the other side of the main processing zone 14 is provided a burner unit 18 for incinerating the noxious vapours released by the particulate material that are then discharged in the atmosphere.

Figure 2:
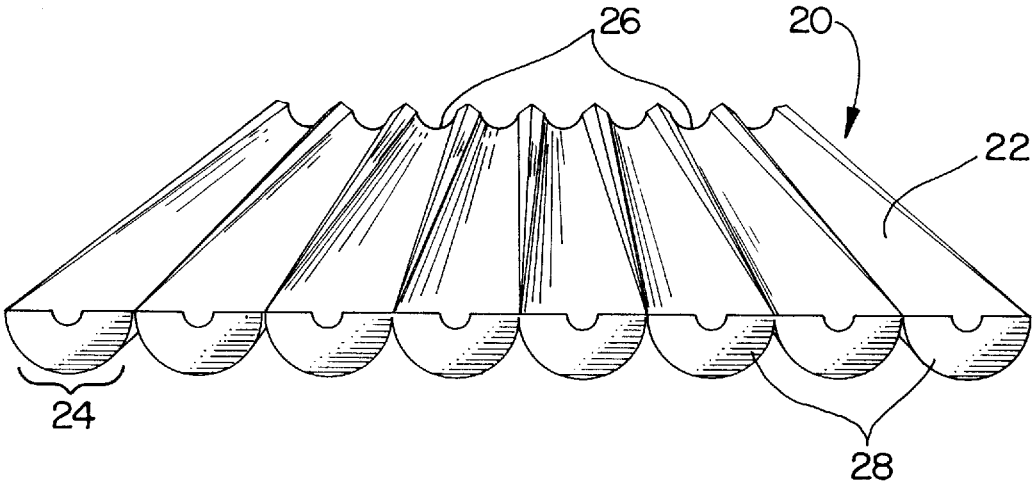
FIG. 2 is a perspective view of a bank of troughs constituting a single level of the serpentine path along which the particulate material is dehydrated in the apparatus, the troughs being viewed from their inlet ends.
Figure 3:
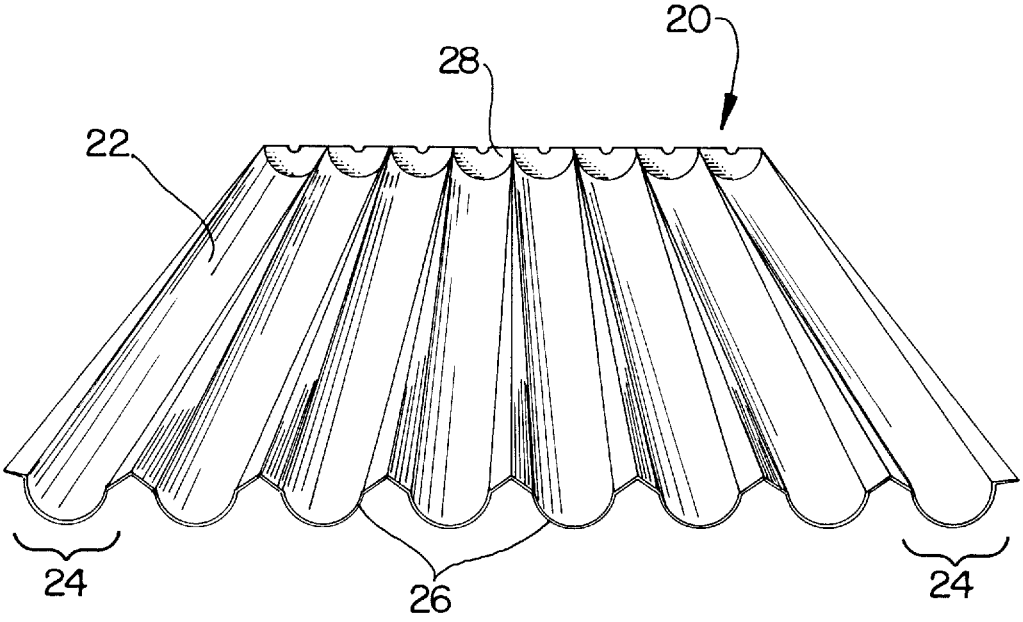
FIG. 3 is a perspective view of the troughs bank shown in FIG. 2, the troughs being shown viewed their outlet ends.
Figure 4:
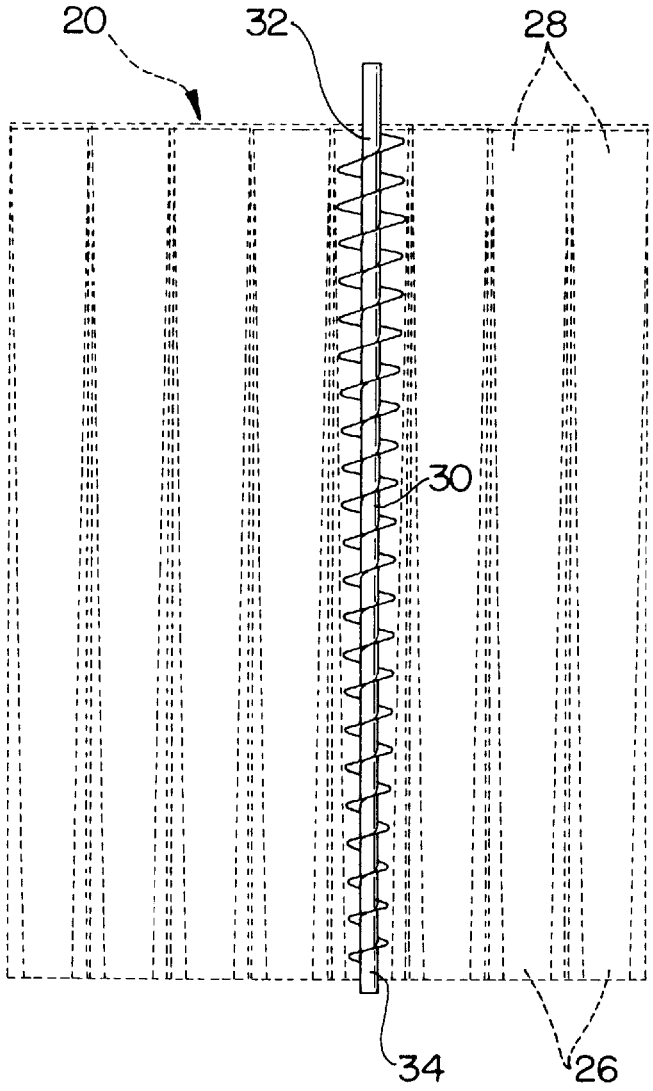
FIG. 4 is a plan view of a screw conveyor for transporting particulate material along a trough.

The main processing zone 14 comprises seven trough banks in a superposed relationship that define a serpentine path for transporting the particulate material to be dehydrated through the apparatus. The structure of the trough banks designated comprehensively by the reference numeral 20 is best shown in FIGS. 2 and 3. Each troughs bank include eight open-top troughs 22 arranged in a parallel relationship and lying in a common plane. Each trough 22 has a gutter-like rounded portion in the form of a longitudinally truncated cylinder whose diameter increases from the outlet end 26 of the trough to its inlet end 28. The purpose of this arrangement is to provide a path for the particulate material being treated that progressively narrows to compensate for the reduction of volume in the material as a result of water evaporation.

Each trough 22 receives an elongated conveyor screw 30 having a complementary shape with the gutter-like rounded projection. More specifically, the screw conveyor has a large diameter extremity 31 received in the inlet end of the trough and a small diameter extremity 34 received in the outlet end 26 of the trough. The reduction of diameter between the extremities 31 and 34 is progressive.

The purpose of the conveyor screws 30 is twofold. Firstly, the conveyor screw transports the particulate material to be treated in the respective trough 22. Secondly, the screw conveyor stirs and agitates the particulate material in order to continuously bring to the surface particles deeply within the body of the material. As a result, the release of water and noxious vapours is achieved much more efficiently.

Figure 5:
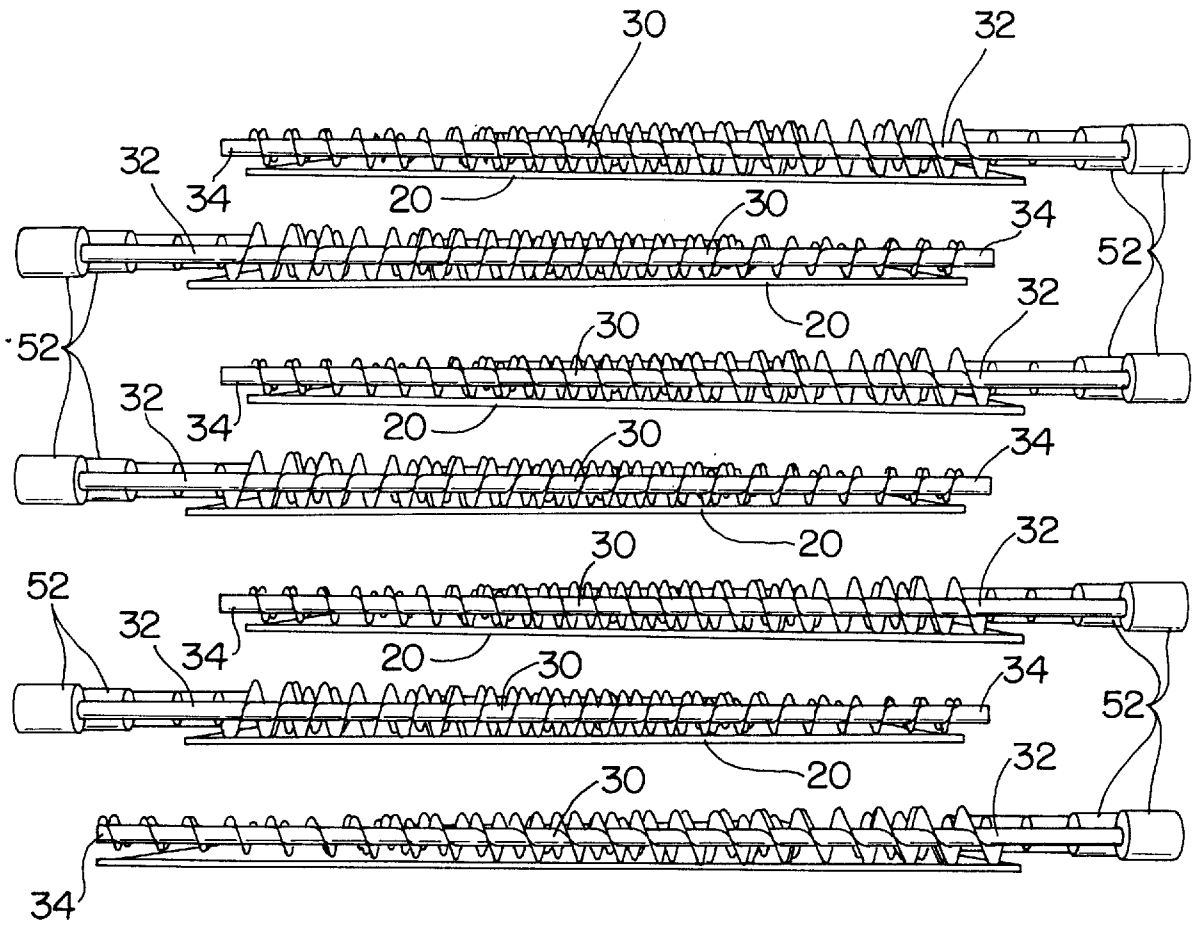
FIG. 5 is a schematical view illustrating the arrangement of the trough banks and of the screw conveyors.

As best shown in FIGS. 1 and 5, the trough banks 20 receive each eight screw conveyors 30 and are disposed in a superposed relationship. All the troughs banks 20 have identical dimensions except the bottom trough bank 20 which is somewhat longer in order to provide a sufficient residence time of the particulate material cooling to take place. The screw conveyors 30 the bottom troughs bank 20 are of a length correspond to the dimension of that troughs bank.

The troughs banks 20 are interconnected by a set of baffles 32 (each set has three individual baffles 32*a*, 32*b* and 32*c* illustrated with dashed lines on FIG. 1) in order to define with the trough banks 20 an air passageway 34 that is continuous from the outlet end 36 of the main processing zone, through which the dehydrated particulate material is being discharged, to the inlet end 38 through which the particulate material to be processed is loaded. In the vicinity of the outlet end 36 is mounted a blower 40 that draws ambient air and directs through the passageway 38 in a direction contrary to the direction of movement of the particulate material therein. The purpose of the air current created in the passageway 34 is to entrain water and noxious vapours that are released from the particulate material being treated. The gaseous media thus collected enters an incineration chamber 42 heated by gas burners 44 with a temperature of at least 750° C. At that temperature, most of the noxious vapours that have been released by the particulate material are incinerated, the resulting gas being substantially clean. The gas burners 44 are of a conventional construction. They incorporate individual blowers that propel the fuel in the process of burning at high velocity in the incineration chamber 42. The flow of burning fuel elevates the temperature of the gaseous media flowing in the incineration chamber 42 and also accelerates the gaseous media in order to increase its speed.

The incinerated gases egressing the incineration chamber 42 passes through a conduit 46 and it is returned to the main processing zone in order to follow the serpentine path defined by the trough banks 20 and the sets of baffles 32. The path of the heated gases discharged from the incinerating chamber 42 is illustrated by the arrows 48. It will be appreciated that the flow of hot gas follows the path along which the particulate material is advanced in order to heat the particulate material and cause same to release water and noxious vapours. However, the baffles in the main processing zone maintain the two gas flows separate from one another to prevent the incinerated gases to become contaminated with noxious vapours released by the particulate material. The incinerated gases are discharged from the main processing zone in the atmosphere through an outlet port 50.

The control zone 60 is provided with an industrial electronic controller that regulates the operation of the various components of the apparatus 10. More particularly, the controller regulates the temperature in the incineration chamber 42 along with the speed of rotation of each screw conveyor 30. In this respect, it should be pointed out that each screw conveyor 30 is driven by an independent electric motor 52.

The apparatus 10 operates as follows. Before loading the main processing zone with waste material to be treated, the gas burners 44 are fired to enable the incineration chamber 42 to reach the desired temperature. The refuse to be treated is discharged on the uppermost trough banks 22 through a feed hopper 54. The screw conveyors 30 rotating in the individual troughs 22 advance the material toward the outlet end 26 of the troughs bank while stirring the material. When the particulate material reaches the extremity 26 of the troughs bank, it falls under the effect of gravity on the second level of the serpentine path and it is again subjected to horizontal displacement on the second troughs bank. This motion of the particulate material continues until the material reaches the outlet end 36. During the movement of the particulate material in the main processing chamber 14, an air current is created by the fan 40 and flows in the passageway 34 with a direction contrary to the direction of movement of the particulate material. The air flow entrains noxious and water vapours released by the particulate material which are directed at the incineration chamber 42 for being burned therein.

It will be appreciated that the inlet of the passageway 34 that corresponds to the location of the fan 40 is adjacent the outlet 36 through which the dehydrated material is discharged. The purpose of this arrangement is to continuously maintain a negative pressure over the particulate material until it is being discharged from the machine 10 in order to ensure that all the possible noxious vapours that are released are being recuperated. The countercurrent flow of air in the passageway 34 also has a desirable cooling effect on the particulate material located on the lowermost troughs bank where the particulate material undergoes a cooling cycle.

During the operation of the apparatus 10, it is desirable to progressively slow the speed of travel of the particulate material through the serpentine path in order to increase the residence time of the material in the high temperature zone and thus, increase the rate of water removal. In this regard, it should be noted that a reduction in the speed of travel of the particulate material is possible and will not cause an overflow at the inlet-end of the machine because water is being gradually removed as the material progresses along the serpentine path. The advantages slowing down the material allows to obtain an increased residence time for a more complete removal of water and noxious vapours. To decrease the speed of the particulate material in the various sections of the main processing zone, the motors 52 of the screws are rotated progressively slower from one level to the other.

Perhaps the most important advantage of the apparatus in accordance with the invention is its ability to operate in a continuous mode with no necessity of interruption. The apparatus can be fitted to an automatic loading machine that meters the refuse in the hopper 54 while a conveyor or any other type of material transport system evacuates the dehydrated waste discharged from the outlet 36. If desired, the vapours released through the outlet 50 can be subjected to additional filtration treatments in order to remove more completely pollutants.

The above description of a preferred embodiment of this invention should not be interpreted in any limiting manner as variations are possible without departing from the spirit of the invention. The scope of the invention is defined in the appended claims and their equivalents.

We claim:

1. An apparatus for dehydrating a particulate material, said apparatus comprising:

a) a channel having an inlet end for receiving the particulate material to be dehydrated and an outlet end for discharging the particulate material in a dehydrated condition, said channel also constituting a passageway through which vapour released by the particulate material is collected and transported;

b) a screw conveyor rotatably mounted in said channel said screw conveyor having:

(i) means for moving the particulate material along said channel in a direction from said inlet end toward said outlet end; and (ii) means for stirring the particulate material to cause disturbance in the relative position of particles thereof, thereby enhancing release of said vapour;

c) a duct in a heat-exchange relationship with said channel said duct conveying a heated gas that communicates thermal energy to the particulate material in said channel to cause the particulate material to release sad vapour, said duct being substantially isolated from said channel in order to prevent contact between the heated gas conveyed by the duct and the vapour conveyed by said passageway;

d) a heating chamber establishing a flow path between said duct and said passageway, said heating chamber comprising means for heating a gaseous medium at a temperature of at least 750° C., whereby the vapour egressing said passageway is supplied to said heating chamber and heated therein to form the heated gas which is supplied to said duct in order to transfer heat to the particulate material in said channel;

e) a fan for creating a gas flow within the passageway in order to direct the vapour collected within the passageway towards the heating chamber;

f) the passageway having an inlet orifice adjacent the outlet end of the channel; and, g) the fan being positioned to circulate air from said inlet orifice into the passageway in order to create an air current in said passageway, said air current flowing in a direction opposite to the direction of movement of the particulate material in the channel;

h) the heating chamber is in direct communication with the duct and the channel, whereby the water vapour egressing the passageway is supplied directly to said heating chamber and the resulting heated gas is supplied directly to the duct.

2. An apparatus as defined in claim 1 wherein said channel includes a plurality of sections forming a serpentine path and said screw conveyor (30) includes a screw rotatably mounted in each section (20) of said serpentine path.

3. An apparatus as defined in claim 2 wherein the sections of said serpentine path extend generally horizontally and are vertically offset one relative to the other, whereby particulate material is transferred from an outlet extremity of a given section to an inlet extremity of a subsequent section in said path through the effect of gravity.

4. An apparatus as defined in claim 3 wherein each section of said path includes a plurality of generally parallel troughs extending in a common plane, each through including a screw to transport particulate material therefrom.

5. An apparatus as defined in claim 4 wherein each screw has a progressively diminishing diameter along a direction of movement of particulate material in the corresponding trough.

6. An apparatus as defined in claim 4 further comprising drive means suitable for rotating the screw of one section at a lower speed than the screw of an upstream section in order to reduce a rate of progression of the particulate material in said path.

7. An apparatus as defined in claim 4 wherein said heating means are selected from the group consisting of electric heating element and a fuel burner.

8. An apparatus as defined in claim 7 wherein said heating means consists of at least one fuel burner located in said heating chamber to elevate the temperature therein, said fuel burner including a blower to propel gases in combustion in said heating chamber, said blower constituting means for accelerating the mixture of air and water vapour passing through said heating chamber.

9. A method for dehydrating particulate material, said method comprising the steps of:

a) loading particulate material to be dehydrated into a channel that constitutes a passageway in which water vapour released by the particulate material is collected and transported;

b) advancing the particulate material along said channel while stirring the particulate material in order to enhance vapour release by the particulate material;

c) supplying the water vapour collected in the passageway to a heating chamber;

d) heating the water vapour supplied to the heating chamber within said heating chamber at a temperature of at least 750° C. in order to produce a heated gas; and e) passing the heated gas in contact with said channel to transfer thermal energy to the particulate material therein without mixing said heated gas with the water vapour in said passageway;

characterized in that it comprises the additional step of:

f) creating an air current in a direction opposite the direction of movement of the particulate material, said air current conveying the released water vapour in said passageway towards the heating chamber, the water vapour that is so collected within the passageway being supplied directly to the heating chamber.

* * * * *